US008915315B2

(12) United States Patent
Boulet et al.

(10) Patent No.: US 8,915,315 B2
(45) Date of Patent: Dec. 23, 2014

(54) DRILL PIPE AND CORRESPONDING DRILL FITTING

(75) Inventors: Jean Boulet, Paris (FR); Stéphane Menand, Bourron-Marlotte (FR)

(73) Assignees: Vam Drilling France, Cosne Cours sur Loire (FR); Association Pour la Recherche et le Developpement de Methodes et Processus Industriels, Paris (FR)

( * ) Notice: Subject to any disclaimer, the term of this patent is extended or adjusted under 35 U.S.C. 154(b) by 396 days.

(21) Appl. No.: 13/384,708

(22) PCT Filed: Jul. 20, 2010

(86) PCT No.: PCT/FR2010/000521
§ 371 (c)(1),
(2), (4) Date: Apr. 16, 2012

(87) PCT Pub. No.: WO2011/010016
PCT Pub. Date: Jan. 27, 2011

(65) Prior Publication Data

US 2012/0199400 A1 Aug. 9, 2012

(30) Foreign Application Priority Data

Jul. 20, 2009 (FR) ..... 09 03560

(51) Int. Cl.

| | |
|---|---|
| ***E21B 17/10*** | (2006.01) |
| ***E21B 47/01*** | (2012.01) |
| ***E21B 47/00*** | (2012.01) |
| ***E21B 17/00*** | (2006.01) |

(52) U.S. Cl.
CPC ..... *E21B 47/01* (2013.01); *E21B 17/1085* (2013.01); *E21B 47/0006* (2013.01); *E21B 17/00* (2013.01)
USPC ..... 175/325.2; 175/320; 464/20

(58) Field of Classification Search
CPC ..... E21B 17/00; E21B 17/10; E21B 47/01; E21B 47/0006; E21B 17/1085
USPC ..... 175/320, 325.2, 424; 138/121; 464/20, 464/79, 80
See application file for complete search history.

(56) References Cited

U.S. PATENT DOCUMENTS 3,263,446 A * 8/1966 Wiggins, Jr. ..... 464/20
3,730,286 A * 5/1973 Weiner ..... 175/320

(Continued)

FOREIGN PATENT DOCUMENTS

WO 2005 086691 9/2005
WO 2008 116077 9/2008

OTHER PUBLICATIONS

International Search Report issued on Mar. 24, 2011 in PCT/FR10/000521 filed Jul. 20, 2010.

*Primary Examiner* — Yong-Suk (Philip) Ro
(74) *Attorney, Agent, or Firm* — Oblon, Spivak, McClelland, Maier & Neustadt, L.L.P.

(57) ABSTRACT

A drillpipe for a drill stem to drill a hole. The drill stem includes a drill string and a bottom hole assembly. The drillpipe includes a first end having a first inertia, a second end having a second inertia, a first intermediate zone adjacent to the first end, a second intermediate zone adjacent to the second end, and a central substantially tubular zone with an external diameter smaller than the maximum external diameter of at least the first or the second end. A casing is fixed on the pipe over a portion of the external surface thereof, at least one physical parameter sensor is disposed in the casing, and at least one data transmission/storage mechanism is connected to the sensor output, the casing being disposed at a distance from the first and second ends, the casing being integral with the central zone at a distance from the first and second intermediate zones and having a smaller inertia than the first and second inertias.

21 Claims, 10 Drawing Sheets

(56) References Cited

U.S. PATENT DOCUMENTS

| | | | | |
|---|---|---|---|---|
| 3,773,359 | A | 11/1973 | Chance et al. | |
| 5,713,423 | A * | 2/1998 | Martin et al. | 175/62 |
| 6,039,130 | A * | 3/2000 | Pruet | 175/320 |
| 2005/0074998 | A1 | 4/2005 | Hall et al. | |
| 2005/0194185 | A1 | 9/2005 | Gleitman | |
| 2005/0200498 | A1 | 9/2005 | Gleitman | |
| 2006/0065394 | A1 | 3/2006 | Clark et al. | |
| 2008/0202742 | A1 | 8/2008 | Hall et al. | |
| 2009/0025982 | A1 | 1/2009 | Hall et al. | |
| 2009/0260876 | A1 | 10/2009 | Gleitman | |
| 2009/0321144 | A1 * | 12/2009 | Wyble et al. | 175/320 |
| 2011/0198126 | A1 * | 8/2011 | Swietlik et al. | 175/55 |
| 2011/0284291 | A1 * | 11/2011 | Nichols et al. | 175/57 |

* cited by examiner

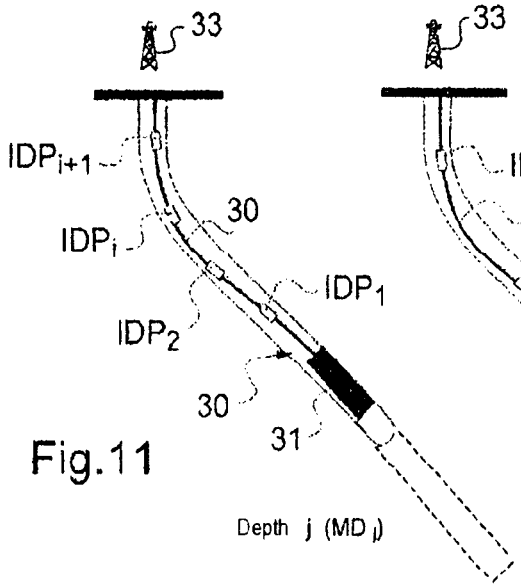
Fig.11
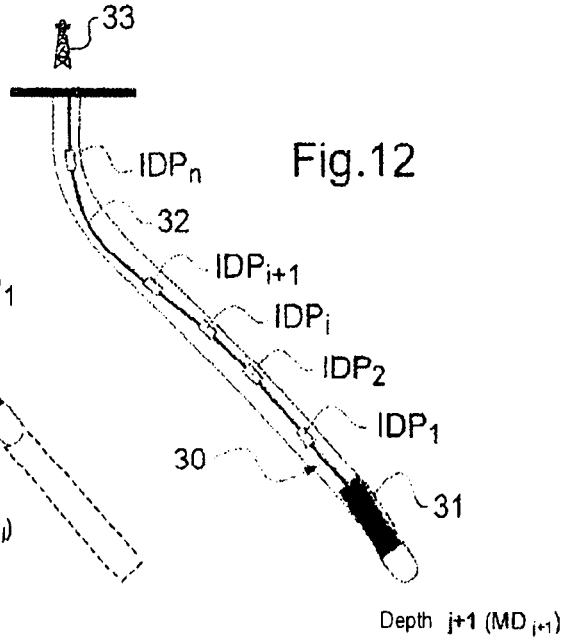
Fig.12
Fig.13
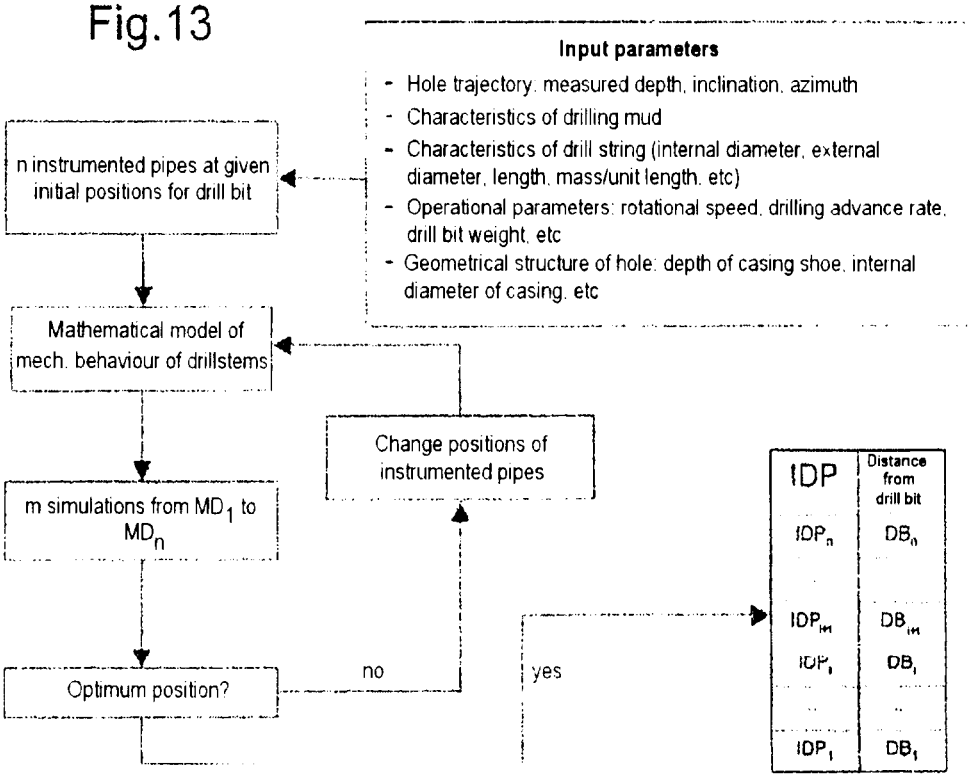

DRILL PIPE AND CORRESPONDING DRILL FITTING

The invention relates to the field of exploration and operation of oil or gas fields in which rotary drill strings are used which are constituted by tubular components such as standard and possibly heavyweight drillpipes and other tubular elements, in particular drill collars at the bottom hole assembly, which are connected end-to-end in a manner suitable for the drilling requirements.

More particularly, the invention relates to a profiled element for drilling equipment, rotary or non-rotary, such as a pipe or a heavyweight pipe disposed in the body of a drill string.

Such strings can in particular be used to produce deviated bores, i.e. bores which can be varied in their inclination with respect to the vertical or the azimuth during drilling. Deviated bores can currently reach depths of the order of 2 to 6 km and horizontal displacements of the order of 2 to 14 km.

In the case of deviated bores of that type, comprising practically horizontal sections, frictional torques due to rotation of the drill strings in the wells may reach very high values during drilling. The frictional torques may compromise the equipment used or the objectives of drilling. Furthermore, the spoil produced by drilling is very often difficult to pull out because of sedimentation of the debris produced in the drilled hole, in particular in the portion of the drilled hole that is steeply inclined to the vertical. The mechanical stress on the tubular components is increased thereby.

For a better understanding of the events occurring at the hole bottom, bottom hole assemblies close to the drill bit may be provided with measuring instruments. However, knowledge of what is happening in the drill string, i.e. between the bottom hole assembly and the surface, is still incomplete, rendering optimization of the construction of the drill stem and the drilling procedure problematic.

The invention will improve the situation.

A drillpipe is provided for mounting in a drill string of a drill stem to drill a hole, in general with circulation of a drilling fluid around said pipe and in a direction moving from the bottom of a drilled hole to the surface. The drill stem comprises a drill string and a bottom hole assembly. The pipe comprises a first end comprising a female threading and having a first inertia, a second end comprising a male threading and having a second inertia, a first intermediate zone adjacent to the first end and having a third inertia, a second intermediate zone adjacent to the second end and having a fourth inertia, and a central substantially tubular zone with an external diameter which is smaller than the maximum external diameter of at least the first or the second end and having a fifth inertia. The third and fourth inertias are each smaller than the first and second inertias and the fifth inertia is smaller than the third and fourth inertias. The pipe comprises a casing fixed on the pipe over a portion of the external surface thereof, at least one physical parameter sensor disposed in the casing, and at least one data transmission/storage means connected to the sensor output, the casing being at a distance from the first and second ends, the casing being integral with the central zone at a distance from the first and second intermediate zones and having a smaller inertia than the first and second inertias.

A drill stem may comprise a drill string, a bottom hole assembly and a drill bit. The bottom hole assembly is connected to the drill bit, and the drill string is disposed between the bottom hole assembly and a means for driving the drill string at the surface, the drill string comprising a plurality of pipes described above. Said pipes are mounted at locations selected as a function of the indications given by a mathematical model of the mechanical behaviour of the drill stems.

The present invention will be better understood from the following detailed description of some embodiments which are given by way of non-limiting examples and are illustrated in the accompanying drawings in which:

FIGS. 11 and 12 are diagrammatic views of drill stems comprising instrumented pipes disposed at two distinct depths;

FIG. 13 is a diagram of a method for determining the optimum position for the instrumented pipes in a drill string;

Figure 1:
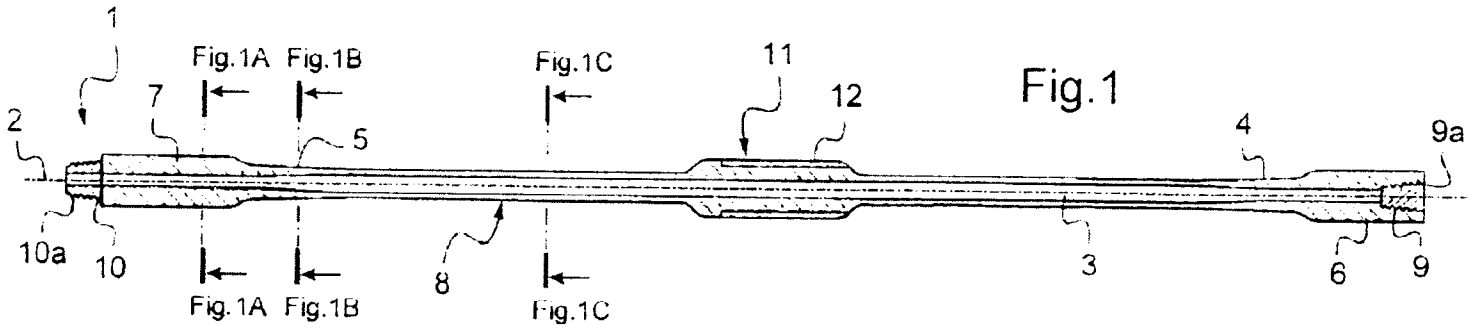
FIG. 1 is an axial sectional view of an instrumented drillpipe.

When excavating a well, a drilling mast is disposed on the ground or on an offshore platform in order to dig a hole in layers of the ground. A drill stem is suspended in the hole and comprises a drilling tool, such as a drill bit, at its lower end. The drill stem may be driven in rotation in its entirety using a drive mechanism, actuated by means that are not shown, for example hydraulic means. The drive mechanism may thus comprise a drive pipe at the upper end of the drill stem. Drilling fluid or mud is stored in a reservoir. A mud pump sends drilling fluid into the drill stem via the central orifice of an injection head, forcing the drilling fluid to flow towards the bottom through the drill stem. The drilling fluid then leaves the drill stem via the channels of the drill hit then rises in the generally annular-shaped space formed by the exterior of the drill stem and the wall of the hole.

The drilling fluid lubricates the drilling tool and brings the excavation spoil disengaged at the hole bottom by the drill bit to the surface. The drilling fluid is then filtered so that it can be re-used.

The bottom hole assembly may comprises drill collars, the mass of which ensures that the drill bit bears against the bottom of the hole. The bottom hole assembly may also comprise components (MWD, LWD, subs, etc) provided with measurement sensors, for example for pressure, temperature, stress, inclination, resistivity, etc. Signals from the sensors may be sent to the surface via a cabled telemetry system. A plurality of electromagnetic couplers may be interconnected inside the drill stem to form a communication link. Reference may, for example, be made to U.S. Pat. No. 6,670,880 or U.S. Pat. No. 6,641,434. The two ends of a drilling component are provided with communication couplers. The two couplers of a component are connected via a cable, substantially over the length of the component.

Having investigated the mechanical behaviour of drillpipes, such as drillpipe fatigue damage, buckling of drillpipes in highly deviated trajectories, the frictional contact between casings and the drillpipes, vibrational phenomena, etc, the Applicant has observed that precisely monitoring the physical parameters along the drill string can validate physical modelling, especially mechanical and hydraulic models. This results in an improvement in the process of drilling as regards technical performance, operational safety and cost. Thus, the capacity to drill a deep, greatly offset hole trajectory is greater.

When drilling highly deviated (large inclination) wells, friction between the drillpipes and the hole wall is very high, causing compression in the drillpipes. This compression is at the origin of buckling phenomena which may then cause the drilling drill string assembly to become wedged in the well or may even cause breakage of the drillpipes. The buckling of drillpipes associated with rotation thereof in fact results in fatigue phenomena. In both cases this results in losses of productivity in drilling; it may even mean that it is impossible to reach the oil reservoir.

Current techniques do not provide physical data for the drill string. The Applicant has developed a device which is aimed at improving information regarding the state of the drill string and/or its environment. Many parameters have an influence on the stresses to which the drill string is subjected, in particular the pressure of the mud inside and outside the pipes, the temperature, the friction of the pipes against the well wall, the rotational torque exerted, the deformation of the pipes, vibrations, etc. The duration of the manoeuvre (complete pull-out of drill stem then going in again) when making a hole can be reduced, which is of particular advantage in terms of reducing the duration of the excavation step, and hence results in large savings. It will be recalled in this respect that complete pull-out of the drill stem followed by going in again is a long-duration operation taking about half a day to a day of work depending on the depth of the hole. Thus, reducing the excavation time is an important factor in productivity.

The Applicant has also established a better control in pulling out drilling spoil, a better safety margin as regards over-tension and over-torsion, good maintenance of mechanical integrity of the threaded connections, a reduction in wear by abrasion of the internal wall of the drilled well, and a reduction in the risks of wedging of the drill stem during a lifting manoeuvre.

In the drill string, a drillpipe may comprise threaded elements and a tube welded end-to-end. Welding a tube to an element may be carried out by friction. Said element may be machined from a short, large diameter part, while the tube may have a smaller diameter, meaning that the mass of metal to be machined and the quantity of machining waste is greatly reduced. Said element may have a length of the order of 0.2 to 1.5 meters. In addition to pipes, the drill stem may also comprise pipes, heavyweight pipes, drill collars, stabilizers, etc.

At least one drillpipe comprises a casing provided with measurement sensors. The casing may be provided with at least one temperature sensor, a deformation sensor (or strain gauge), a pressure sensor, an accelerometer, a magnetometer, etc. A strain gauge is capable of measuring various components of the stress and strain tensors (tension and shear) and from them, the axial, circumferential, torsional or bending stresses and deformations, in particular buckling, can be determined. If it is orientated in a plane normal to the axis of the pipe, the accelerometer can measure a lateral acceleration and the vibrations to which the pipe is subjected. If it is orientated in the axis of the pipe, the accelerometer can measure an axial acceleration and the inclination of the pipe. The magnetometer (sensor measuring the direction and intensity of a magnetic field) can provide information regarding the angular orientation of the instrumented pipe with respect to the earth's magnetic field and the rate of rotation of the pipe.

In one embodiment, the drillpipe comprises at least one pipe in accordance with patent application FR 2 851 608 and/or in accordance with patent application FR 2 927 936; the reader is invited to refer thereto.

The components of the drill stem are produced in tubular form and are connected together end-to-end, such that their central channels are in their mutual extensions and constitute a continuous central space for circulation of a drilling fluid from top to bottom between the surface from which drilling is being carried out to the hole bottom where the drilling tool is working. The drilling fluid or mud then rises in an annular space defined between the wall of the drilled hole and the external surface of the drill stem.

The drilling fluid, as it rises outside the drillpipe, entrains debris from geological formations through which the drilling tool passes to the surface from which drilling is being carried out. The drill stem is designed so that it facilitates the upward motion of the drilling fluid in the annular space between the drill stem and the well wall. Ideally, the drilling debris is entrained in an effective manner to flush the drilled hole wall and the bearing surfaces of the drill stem in order to facilitate advancement of the drill stem inside the hole.

The characteristics of a drill stem contribute to the fundamental properties of quality, performance and safety of the general drilling procedure either during the excavation phases itself or during phases for manoeuvring between the bottom and the surface. Changes in hydrocarbon exploration demand profiles with ever more complex trajectories under ever more extreme geological conditions. Currently, hydrocarbon exploration is being carried out at depths which are routinely over four kilometers and at horizontal distances with respect to the fixed installation that may exceed ten kilometers.

The Applicant has observed that characteristics, in particular geological, mechanical and hydraulic, in the region of the drill string were little known. The bottom hole assembly may be equipped with sensors to provide data relative to events occurring in the hole bottom. Document US 2005/0279532 describes the principle of a drill stem with distributed sensors. However, the precise arrangement of a sensor and of a drillpipe remains ignored.

Document WO 2005/086691 mentions a sensor mounted at the end of a pipe in a very thick zone and also a sensor housed in a cover element. The very thick zone, with high inertia and thus insensitive to bending and torsion, does not allow the corresponding forces to be detected very accurately. The cover element turns out to be fragile both outside the drilled hole and in it.

However, the constitution of a drillpipe must satisfy exacting demands which are often contradictory as regards thickness, rigidity under tension, buckling and torsion, fatigue resistance, internal pressure and external pressure resistance, disconnection (breakout), the seal of the connections, the external diameter, the hydraulic pressure drop, both internal and external, the external motive force for the mud, the low friction on the well wall, resistance to aggressive chemical compounds such as $H_2S$, data transmission, etc. This is supplemented by the fact that at least one sensor has to be mechanically, hydraulically and chemically protected and exposed to the phenomenon which said sensor is designed to measure.

The Applicant has developed an improved drillpipe provided with at least one sensor which, inter alia, can measure the buckling behaviour of the pipe and neighbouring pipes. The term "mathematical model" is used for the model for computing the mechanical behaviour of the drill stems.

As can be seen in FIG. 1, the pipe 1 is a body of revolution about an axis 2 which substantially constitutes the drilling axis when the pipe 1 of a drill string is in a service position inside a drilled hole produced by a tool such as a drill bit disposed at the end of the drill stem. The axis 2 is the axis of rotation of the drill string. The pipe 1 has a tubular shape, a channel 3 which is substantially a cylindrical body of revolution being provided in the central portion of the pipe 1.

The components of the drill stem, especially the drillpipe string pipes, are produced in the tubular form and are connected together end-to-end, such that their central channels 3 are in each others' mutual extension and constitute a continuous central space for circulation of a drilling fluid from top to bottom between the surface from which drilling is carried out to the bottom of the drilled hole where the drilling tool is operated. The drilling fluid or mud then rises in an annular space defined between the wall of the drilled hole and the external surface of the drill string. A drill stem may comprise pipes, heavyweight pipes, pipe collars, stabilizers or connectors. Unless otherwise mentioned, the term "drillpipe" or "pipe" as used here denotes both drillpipes and heavy weight drillpipes generally located between the drill string and the bottom hole assembly. The pipes are assembled end-to-end by makeup into a drill string which constitutes a major part of the length of the drill stem.

The Applicant has observed that the physical parameters along the drill string, i.e. between the surface and the bottom hole assembly, are of great importance. It is important to measure them and these measurements have to be exploited. The drill string rubs in rotation and in translation against the wall of the drilled hole. The friction causes slow but significant wear of the components of the drill string and relatively rapid wear of the walls of the drilled hole or of the casing already in position which may compromise the mechanical integrity of the casing and thus cause a problem with the stability of the well walls. The friction between the drillpipes and the walls of the drilled hole may cause wedging of the pipe (keyseat) which is prejudicial to the drilling operation. The invention can reduce these risks.

Figure 1C:
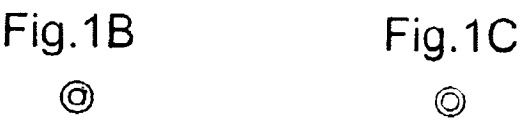
FIGS. 1A to 1C are cross-sectional views of the drillpipe of FIG. 1 in an end section, in an intermediate zone and in a central zone.
Figure 1B:
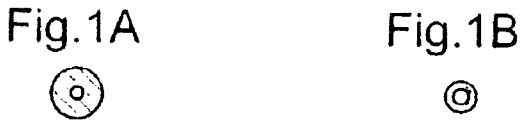
Figure 1A:
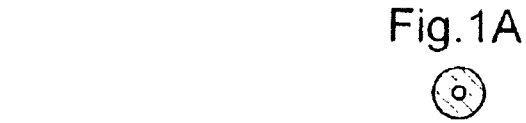

The pipe 1 may be produced from high strength steel, integrally or produced in sections then welded together. More particularly, the profiled pipe 1 may comprise two profiled sections with ends 6 and 7 which are relatively short (length less than 1 meter, for example close to 0.50 m), see FIG. 1A, forming connectors for the pipes known as tool joints, two intermediate zones 4, 5 with a length of less than 1 meter, for example close to 0.50 m, see FIG. 1B, and a central tubular section 8 with a length which may exceed ten meters, see FIG. 1C, welded together. The central section 8 may have an external diameter that is substantially smaller than the end sections (for example 149.2 mm and 184.2 mm respectively) and with an internal diameter which is substantially larger than the end sections (for example 120.7 and 111.1 mm respectively). In this manner the inertia (or quadratic moment) of the end sections 6, 7 with respect to the axis of the pipe 1 may be much higher (for example 3 to 6 times higher) than that of the central section 8. Manufacture of the long central section 8 from short end sections 6, 7 can significantly reduce the quantity of waste, in particular machining turnings. In this manner, a considerably higher yield is obtained. The central section 8 may be in the form of a central portion of a tube with a substantially constant bore and with a substantially constant external diameter (nominal diameter of the drillpipe) with an extra thickness at the ends towards the sections 6 and 7 obtained by reducing the internal diameter (internal upset) in order to facilitate connecting said sections 6 and 7 by welding. The intermediate zones 4 and 5 include these extra thick ends and connect the sections 6 and 7 to the central section 8. The intermediate zones have inertias with respect to the axis of the pipe 1 which are smaller than the inertias of the sections 6 and 7 and higher than the inertia of the central section 8.

In general, the description below is given from the free end of section 6 to the free end of the section 7. The section 6 (or female tool joint) comprises a female connection portion 9 with a cylindrical annular external surface comprising a bore provided with a female threading 9*a* for connection with a male threading of another pipe 1. The connection portion 9 may be in accordance with API specification 7 or in accordance with U.S. Pat. No. 6,153,840 or U.S. Pat. No. 7,210,710; the reader is invited to refer thereto. The connection portion 9 constitutes the free end of the end section 6. The section 7 (male tool joint) comprises a male connection portion 10 with a cylindrical annular external surface comprising a male threading 10*a* for connection to a female threading of another pipe 1. The shape of the male threading 10*a* matches that of the female threading of another pipe. The connection portion 10 constitutes the free end of the end section 7.

In the embodiment of FIG. 1, the pipe 1 comprises a casing 11 disposed around a central section 8 substantially mid-way between the sections 6 and 7. The casing 11 may be disposed at a distance from the sections 6 and 7 that is greater than or equal to the length of said sections 6, 7, preferably at a distance from the intermediate zones 4 and 5 that is greater than or equal to the length of said sections 6, 7. The casing 11 may be at a distance from the first and second intermediate zones 4, 5 in the range 40% to 60% of the distance between the first intermediate zone 4 and the second intermediate zone 5.

The casing 11 has a substantially annular exterior form. The casing 11 here has an external cylindrical surface of revolution 11*a* concentric with the central section 8 connecting to the external surface of the central section 8 via a substantially tapered upstream surface 11*b* and a substantially tapered downstream surface 11*c* forming a profile in longitudinal section limiting the pressure drop of the flow of drilling fluid charged with drilling debris around the pipe (in the annular space between the hole wall and the pipe). The angle of the generatrix of these tapered surfaces 11*b*, 11*c* may thus be 30° or less. The upstream 11*b* and downstream 11*c* tapered surfaces have fillet radii to the adjacent cylindrical surfaces (radius of said fillets preferably being more than 10 mm). The external surface 11*a* has an external diameter that is less than or equal to the external diameter of the end sections 6, 7. More precisely, in order to accommodate imperfections in the roundness of the casing 11 and the end sections 6, 7, the external surface 11*a* may be inscribed in a circle the maximum external diameter of which is less than or equal to the maximum diameter of the end sections 6, 7.

The casing 11 may comprise a body 12, also termed a base, and one or more covers 13. The body 12 forms a boss with respect to the central section 8. The body 12 has an external surface tangential to the external surface of the central section 8. The body 12 is preferably integral with the central section 8, for example produced by external upset or machining, such that in particular the body 12 is subjected to the same stresses as the central section 8. The body 12 and the cover 13 define a housing 14, in this case substantially parallelepipedal in shape. The casing 11 has an external diameter which is smaller than the maximum diameter of the pipe so that it is protected from abrasion by the walls of the hole and its length is as short as possible, less than 200 mm, for example of the order of 150 mm, in order to perturb the hydraulic characteristics of the central section 8 and the stresses to which it is subjected as little as possible. The external diameter of the casing 11 is advantageously selected such that the inertia of the casing 11 with respect to the axis is not too much greater than that of the adjacent central section, for example in the range 100% to 200%, preferably in the range 130% to 180% of the inertia of the central section. Preferably again, the inertia with respect to the axis of the casing 11 is less than or equal to that of the intermediate zones 4 and 5. The cover 13 may be in the form of a plate with an external surface that is convexly domed in cross section, see FIG. 2, matching the shape of the external surface of the body 12, and with a planar or concave internal surface. The cover 13 may render the housing 14 liquid-tight, even at the high service pressures encountered during drilling of hydrocarbon or geothermal wells, for example by using a synthetic elastomeric material-type peripheral gasket. The cover 13 may be attached using screws. The rim of the cover 13 in contact with the body 12 may be provided with at least one bead or groove forming a baffle that improves the seal.

The pipe 1 comprises at least one sensor 15 disposed in the housing 14, for example as shown here, screwed into a tapped blind hole pierced in the bottom of the housing 14 and forming part of the housing. Advantageously, said blind hole is of a depth such that the thickness of material under said blind hole (between the bottom of the blind hole and the bore 3) is at least equal to that of the regular section of the central section 8 so as not to affect the mechanical integrity of the pipe. In other words, the thickness of the material of the casing between the sensor 15 and a bore 3 of the pipe is greater than or equal to the thickness of the central zone 8 of the pipe. In a variation, the sensor 15 may be fixed to the body 12 by any other means, for example by bonding to a planar portion of the bottom of the housing 14 (the thickness of material is then considered to be that between said planar portion and the bore 3). The pipe 1 may comprise a source of electrical energy 16 disposed in the housing 14. The source of electrical energy 16 or supply may comprise a cell or a battery, for example disposed in a housing that is a cylinder of revolution 17. Said cylinder of revolution housing 17 may be obscured by a threaded plug 18 that is distinct from the cover 13 and cooperates with a female threading provided in the wall of the body 12. A supply cable 19 connects the source of electrical energy 16 and the sensor 15. The housing 14 may also comprise electronic means for processing the signals from the sensor 15, in particular to digitize said signals.

A memory 20 may be disposed in the housing 14, connected to the sensor 15 and configured to record data deriving from the sensor 15. The memory 20 may form part of a memory card. Alternatively or in addition to the memory 20, the pipe 1 may be provided with a remote communication link so that the operators can receive real-time data, or very nearly real-time data depending on the speed of the link, from the sensor 15. The remote communication link may be hard-wired into the pipe 1, for example via a communication cable 21, and be electromagnetic between two pipes. Reference may be made to the documents U.S. Pat. No. 6,670,880, U.S. Pat. No. 6,641,434, U.S. Pat. No. 6,516,506 or US-2005/115717 for the communication coupling between two adjacent pipes. Other types of coupling may also be used (direct contact, aerial, etc).

The sensor 15 may be a temperature sensor, for example in a range of up to 350° C. The sensor 15 may be associated with a filter that is not shown in order to transmit temperature data beyond a pre-adjusted threshold.

The sensor 15 may be a sensor for the direction and intensity of the magnetic field. The magnetometer can recognize the angular orientation of the instrumented pipe with respect to the earth's magnetic field. It can also allow a measurement of the effective rate of rotation of the pipe and will thus be able to detect stick-slip problems.

The sensor 15 may be a pressure sensor, for example in a range which may be up to a value in the range $35\times10^6$ Pa (substantially 5100 psi) to $25\times10^7$ Pa (substantially 36300 psi). The pressure sensor may have a means that opens into the channel 3 to measure the internal pressure. The pressure sensor may have a means that opens to the outside of the casing 11 to measure an external pressure in the annular space between the wall of the drilled hole and the drillpipe. Two pressure sensors may be disposed in the housing 14. They can in particular allow a measurement of the pressure drops of the drilling fluid and allow detection in the event of large pressure drops of a sticking phenomenon between the pipe and the wall of the well and the onset of such a phenomenon.

The sensor 15 may be an acceleration sensor (accelerometer), for example in the range 0 to 100 $ms^{-2}$. The accelerometer may detect high frequency accelerations, for example up to 1000 Hz. The measurement of accelerations by axially, tangentially and laterally disposed accelerometers means that axial, torsional and lateral vibrations can be measured. An axial accelerometer can also provide an indirect measurement of the inclination and a tangential accelerometer can provide an indirect measurement of the rate of rotation of the pipe. It is thus advantageous to install the sensors 15 to measure accelerations in various directions.

The sensor 15 may be a deformation sensor (or strain gauge), which can measure the geometrical components of torsion, flexion, tension, compression, elongation, shear, etc and thus measure the components of the stress tensor, in particular tension and shear, and allow a determination of the axial, circumferential, torsional or bending stresses and deformations, in particular buckling.

In a variation of the embodiment of FIG. 1, not shown, the pipe 1 is similar to the preceding embodiment with the exception that the casing 11 is disposed in an offset manner with respect to the mid-point of the pipe 1 (plane located midway between the intermediate zones 4 and 5), for example at a distance which may be up to of the order of 3 meters with respect to the mid-point but preferably up to a distance of the order of 1 meter from said mid-point.

Figure 3:
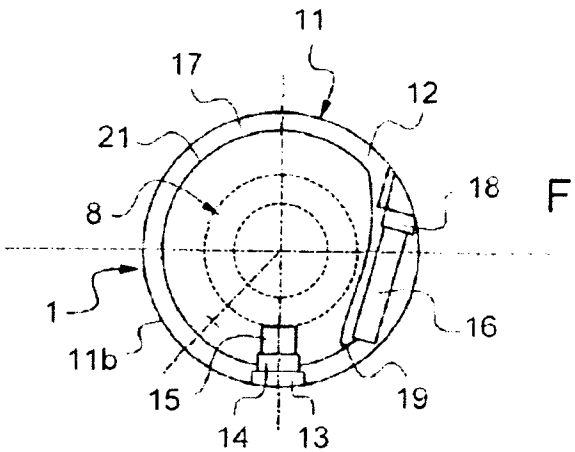
FIG. 3 is a sectional view in a radial plane of another embodiment of the drillpipe of FIG. 1.
Figure 2:
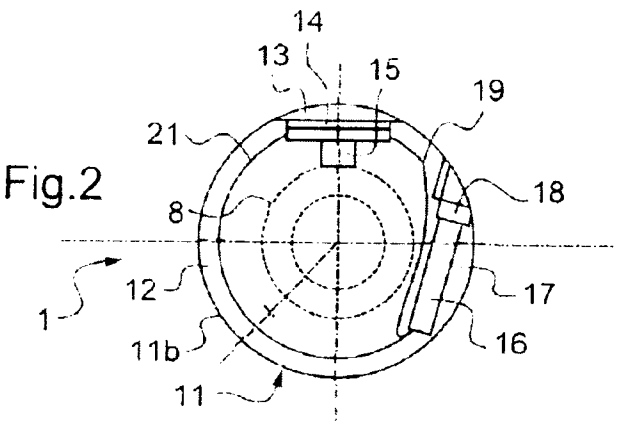
FIG. 2 is a sectional view in a radial plane of the drillpipe of FIG. 1.

In the embodiment illustrated in FIG. 3, the casing 11 is similar to that of the embodiment shown in FIG. 2 with the exception that the cover 13 is in the form of at least one plug provided with a male threading on its external surface provided to cooperate with a corresponding female threading arranged in the body 12. The cover 13 may be provided with a drive element, for example in the form of a blind six sided hole allowing the cover 13 to be screwed or unscrewed using a suitable male key. This embodiment has the advantage of a particularly simple structure and a robust plug. This embodiment of the casing 11 is compatible with the various possible positions of the casing 11, along the pipe 1. The cover may comprise a plurality of plugs.

Figure 4:
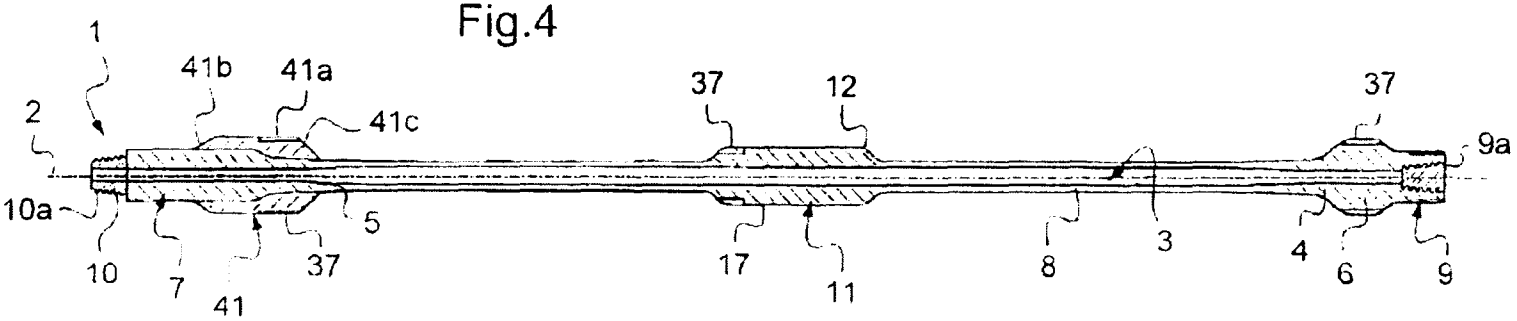
FIG. 4 is an axial sectional view of an instrumented drillpipe.

The embodiment illustrated in FIG. 4 is similar to that of FIG. 1 with the exception that a supplemental casing 41 is in contact with (or integrated into) the end section 7. The supplemental casing 41 has an external diameter which is greater than the external diameter of the end section 7. The supplemental casing 41 partially covers the end section 7 on the side opposite to the connection portion 10. The supplemental casing 41 has an external surface of revolution 41*a* which is cylindrical or slightly domed connecting the external surface of the end section 7 via a substantially tapered guide surface 41*b* with a rectilinear or convexly domed generatrix connecting the external surface of the intermediate zone 5 via a substantially tapered guide surface 41*c* with a length and/or slope that is higher than the preceding one but with a substantially similar shape. The external surface 41*a* has a diameter which is the maximum diameter of the pipe and is capable of bearing against the wall of the drilled hole or casings lining the upper portion thereof. The external surface 41*a* advantageously comprises an anti-abrasion coating with a hardness that is greater than the hardness of the other external surfaces of the pipe. Such an external surface and such guide surfaces may be produced in accordance with the indications provided in documents FR2 851 608 and FR 2 927 936 cited above. One or the other of the guide surfaces 41*b*, 41*c* may in particular comprise helical grooves that can scoop up debris and eject it from the contact zone between the surface 41*a* and the wall of the hole or the casing. The supplemental casing 41 comprises a staggered bore with a small diameter portion in contact with the external surface of the central section 8, a large diameter portion in contact with the external surface of the end section 7 and a tapered connecting surface. The internal structure of the supplemental casing 41 may be of the type illustrated in FIG. 2 or FIG. 4. The supplemental casing 41 may in particular house a supply and/or electronics for the casing 11, which in particular means that the dimensions of said casing 11 can be reduced and thereby its inertia with respect to the axis can be reduced. A passage for cables may be provided between the casing 11 and the supplemental casing 41. The opposite end section 6 may also have an external diameter and a profile which are substantially identical to those of the surface 41*a* in accordance with the teaching of documents FR 2 851 608 and FR 2 927 936. The supplemental casing 41 may be integral with the end section 7 and/or the intermediate zone 5.

Figure 5:
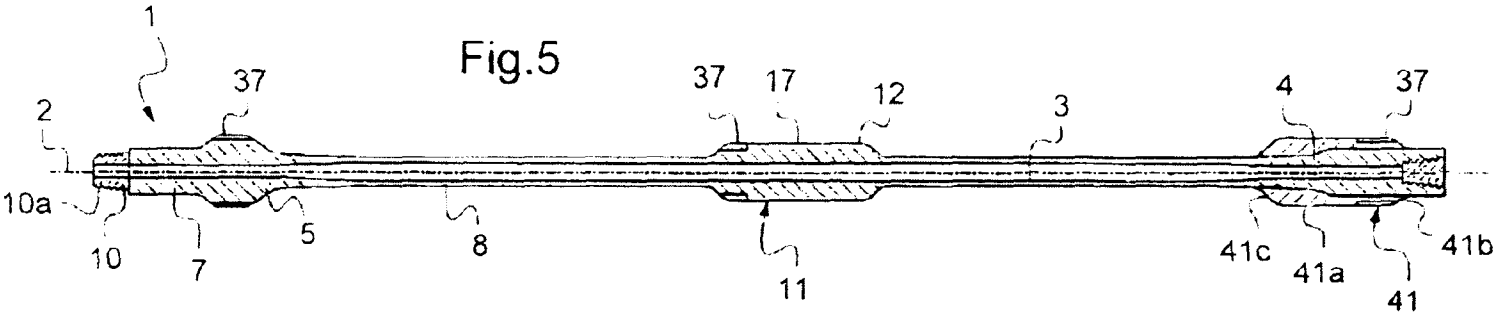
FIG. 5 is an axial sectional view of an instrumented drillpipe.
Figure 6:
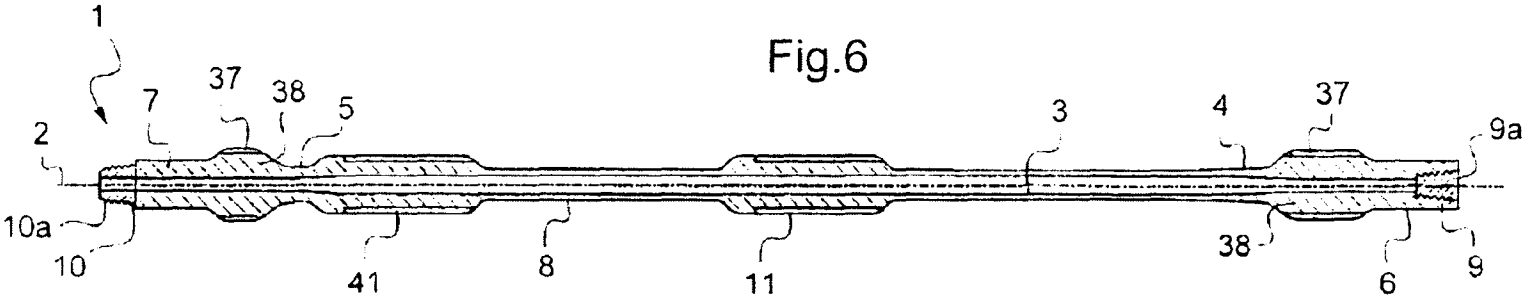
FIG. 6 is an axial sectional view of an instrumented drillpipe.

In the embodiment shown in FIG. 5, the supplemental casing 41 has a similar shape to that of the preceding embodiment and is disposed on the opposite side in contact with and partially covering the end section 6. Its external surface 41*a* of maximum diameter may also be provided with an anti-abrasion coating. The opposite end section 7 may also have an external diameter and a profile which are substantially identical to those of the large external diameter surface of the supplemental casing 41 as disclosed in documents FR 2 851 608 and FR 2 927 936. An anti-abrasion coating may be provided on a maximum diameter portion of at least one end section 6, 7. As can be seen in FIG. 6, a supplemental casing 41 may be disposed at an intermediate zone 4, 5. At least one and preferably both end sections 6, 7 may have a portion 38 with an external diameter that corresponds to the maximum diameter of the pipe, provided with an anti-abrasion coating 37. The profile of this portion may be as disclosed in documents FR 2 851 608 and FR 2 927 936. Casings 11 and 41 are connected via a wired connection 39.

Figure 7:
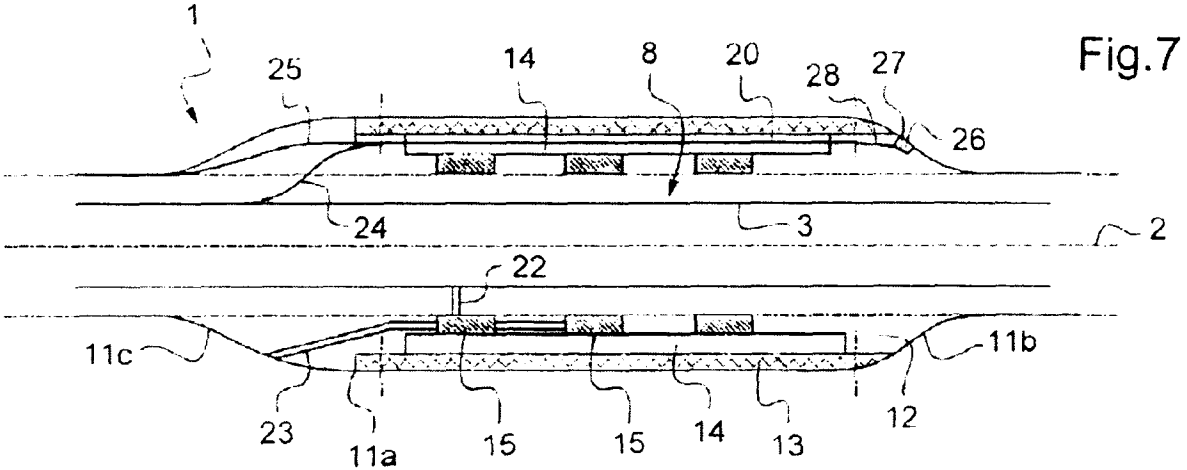
FIG. 7 is a detailed axial sectional view of a drillpipe of the type of FIG. 1 or 4 to 6.

In the embodiment illustrated in FIG. 7, the casing 11 is disposed on the central section 8 as illustrated in FIGS. 1 and 3. The body 12 is integral with the central section 8, for example forged or machined. The housing 14 is obscured by two plate type sealing covers 13 which are diametrically opposed and fixed to the body 12 by screws. A plurality of sensors 15 is mounted in the housing 14, for example six disposed in two lines of three sensors at 180° in order to optimize the stress measurements. The sensors 15 may comprise a pressure sensor in communication with the channel 3 via an aperture 22 to measure the internal pressure and in communication with the exterior of the pipe 1 via an aperture 23 opening onto a tapered connecting surface adjacent to the central section 8. The sensors may comprise a plurality of strain gauges which allow deformations and three-dimensional forces to be estimated, in particular the tension, compression, torsion, bending moments, and buckling. The sensors 15 are provided with a wire connection via a cable 24 which rejoins the central channel 3 passing via a corresponding aperture provided in the thickness of the body 12 and the central section 8. Another communication cable 25 opens outside the casing 11 adjacent to the central section 8 via a corresponding aperture opening into the tapered end surface of the body 12 forming a link between the receptacle 12 and another casing, for example the casing 41 of FIG. 5.

The casing 11 also comprises a connector 26 disposed in a cavity 27 provided in the body 12 on the tapered connecting surface and provided with a sealing plug. The connector 26 is connected via a communication cable 28 to the sensor 15. The connector 26 allows data from the sensors 15 and stored in the memory 20 to be downloaded after the pipe has been pulled up to the surface. The connector 26 may be replaced by a wi-fi transmitter allowing contactless downloading with a suitable receiver.

Figure 8:
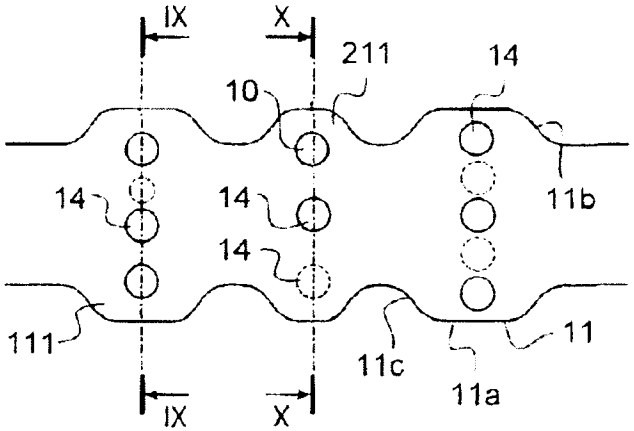
FIG. 8 is a partial side view of a pipe with a plurality of casings.

In the embodiment illustrated in FIG. 8, a pipe comprises a plurality of casings 11, 111, 211, for example three, each being short, for example less than 150 mm, or even less than 130 mm. Each casing 11 comprises a plurality of chambers 14 formed in blind holes provided from the external surface of the body 12. A chamber 14 may correspond to a boss. The bosses of a casing are disposed in at least one circular array. At least one of the arrays may be provided with an anti-abrasion coating. Said array may have an external diameter that is greater than the external diameter of at least one neighbouring array.

Each chamber 14 is closed by a cover 13 on the external side and receives a sensor 15 in its bottom or a battery 16 or an electronic component or a memory 20. The cover 13 may be in the form of a plug with a threaded outer edge which mates with a tapped region provided on the walls of the blind hole. The casings 11, 111, 211 may have substantially equal external diameters. Advantageously, the central casing 211 has an external diameter which is smaller than that of the lateral casings 11, 111, which means that its external surface is protected against abrasion. The casings 11, 111, 211 may have a large diameter surface which is substantially cylindrical with a rectilinear or slightly convexly domed generatrix matching with the external surface of the regular section of the central zone 8 via an upstream tapered zone and a downstream tapered zone connecting via appropriate fillets. The large diameter surfaces may be protected by a hard coating 37.

Figure 10:
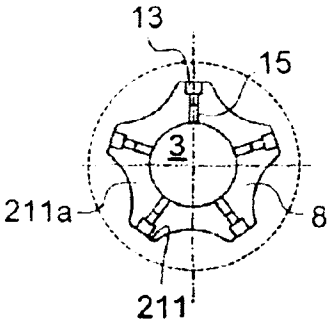
FIG. 10 is a sectional view along X-X in FIG. 8.
Figure 9:
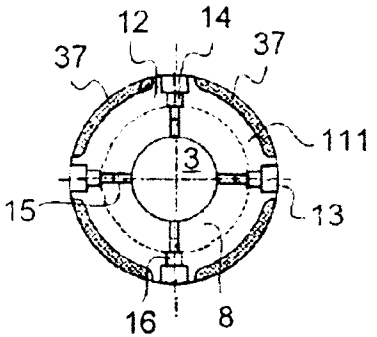
FIG. 9 is a sectional view along IX-IX in FIG. 8.

As can be seen in FIGS. 9 and 10, the casings may have different cross sectional shapes. The lateral casing 111 illustrated in FIG. 9 (or the lateral casing 11, not shown) has a circular external surface. Hardfaced, high hardness zones may be provided between the chambers. As can be seen in FIG. 10, the casing 211 has valleys angularly separating two chambers disposed substantially in the same radial plane. The chambers are provided in bosses which project outwardly.

The arrangement of a series of short casings means that the mechanical characteristics of the regular section of the central zone 8 are approached, in particular as regards flexion and torsion. This results in better capture of the mechanical parameters to be measured or estimated. The casing 211 illustrated in FIG. 10 means that pressure drops in the stream of drilling mud are small. The casing 111 illustrated in FIG. 9 benefits from reduced wear during friction against the outer walls of the drilled hole or predisposed casing and low abrasion of the internal walls of the hole or casing. The juxtaposition of the casings 111 and 211 at a distance in the range 100 to 300 mm is advantageous.

As illustrated in FIGS. 11 and 12, a drill stem 30 comprises a bottom hole assembly 31 and a drill string 32 disposed between the bottom hole assembly and a surface installation 33. The drill string 32 comprises a plurality of pipes 1 at spacings selected as a function of the results provided by the digital or analytical mathematical model of the mechanical behaviour of the drill stems. The pipes 1 have been shown in a number of four (FIG. 11) or five (FIG. 12) for reasons of simplicity of the drawing. In practice, their number depends on the length of the drill string and may be expressed as a percentage of the number of pipes, in particular greater than 1%, preferably greater than 5%. The distribution of the pipes 1 may be regular or otherwise. The other pipes of the drill string 32 may be of the integrated transmission type, for example wired inside a pipe and electromagnetic between two pipes. The data supplied by the pipe sensors 1 are thus communicated to the surface and may be stored in memories then processed by a model to present it to a man-machine interface. The model may be a digital or analytical model for computing the mechanical behaviour of drill stems. Thus, information may be available relating to the behaviour of the pipes of the drill string 32 and not only to the behaviour of the components of the bottom hole assembly 31. The data from the sensors 15 disposed in the pipes 1 prove to be of more importance when the drilled hole is long and has a high degree of curvature or has changes in curvature, which is a function of the type of drilling trajectory.

FIGS. 11 and 12 show an example of the positioning of the bottom hole assembly and the drill string assembly provided with instrumented pipes at 2 successive drilling depths, MDj and MDj+1. A rank 1 instrumented pipe ($IDP_1$) is provided, for example, with 3 sensors which can measure a physical parameter M1, M'1 and M"1. M possibly being the measurement from a deformation sensor (measuring the tension, compression, torsion, bending moment, deformation) or from an accelerometer (measuring axial, torsional and lateral accelerations). The instrumented pipe of rank i ($IDP_i$) may have one or more sensors for one or more measurements M1, M'1, M"1 etc. The term Mi,j is applied to the measurement of a physical parameter for an instrumented pipe of rank i (IDPi) carried out at a depth j (MDj) or at a given time during drilling.

Figure 14:
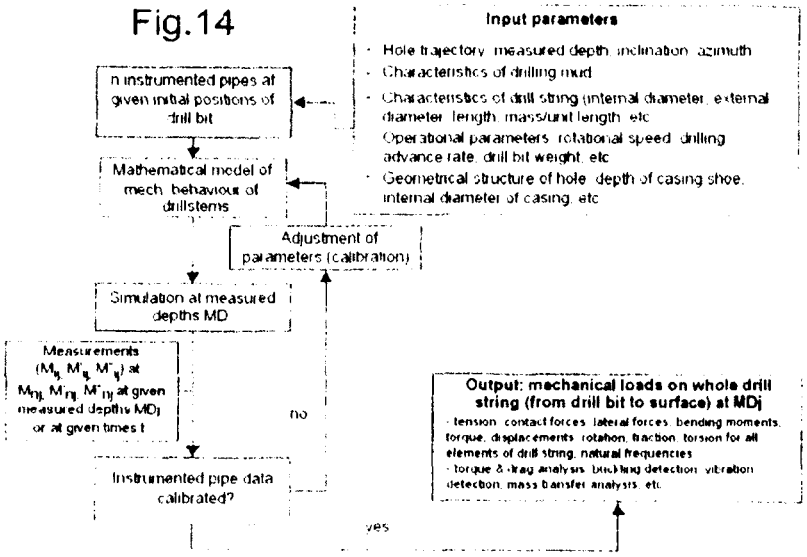
FIG. 14 is a diagram of a calibration method for a model for estimating the mechanical loads in a drill string.
Figure 16:
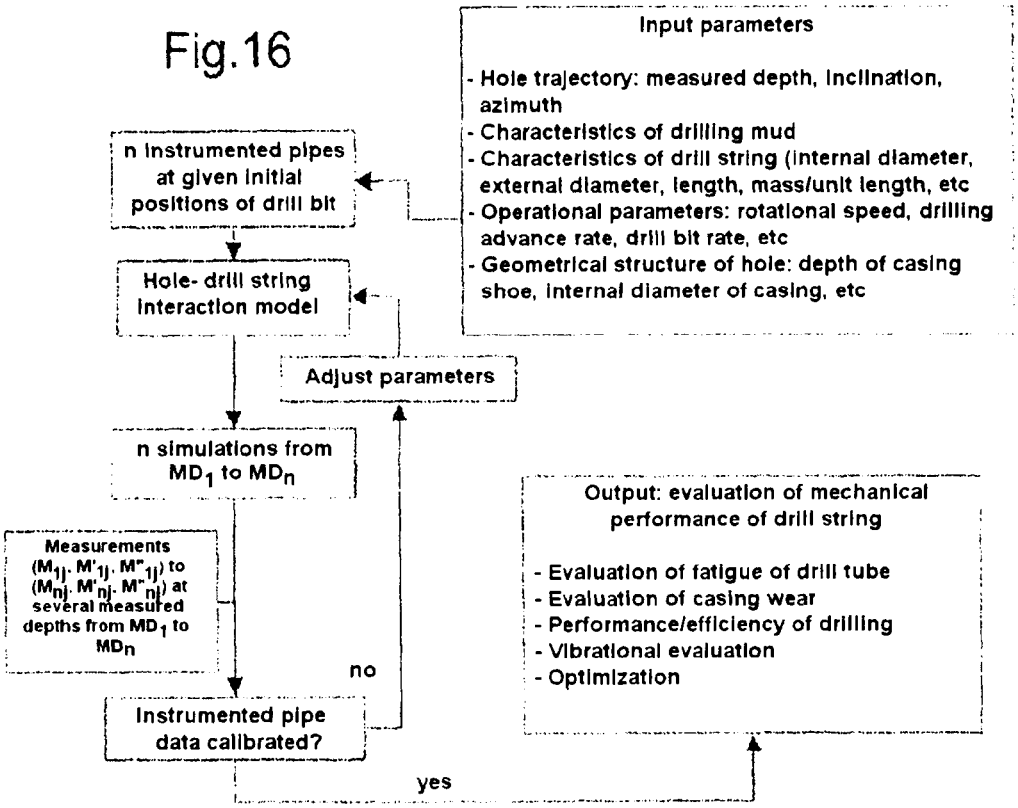
FIG. 16 is a diagram of a calibration method for a model for evaluating the mechanical performance of a drill string.

The mathematical model (digital or analytical) for the mechanical behaviour of the drill stems, see FIGS. 13, 14 and 16, allows, as a function of the drilling trajectory (depth, inclination and azimuth), the characteristics of the drilling mud (density, type, rheology), the characteristics of the drill string assembly and bottom hole assembly (length, internal and external diameter of the pipe body and the connections, weight per unit length. Young's modulus, etc for each element), the characteristics of the casings that are in place (depth of shoe, internal and external diameter), the operating parameters (rate of drilling progress, manoeuvring speed, rotational speed, weight on drill bit etc) and the coefficients of friction between the drillpipes and the walls of the drilled well, to calculate the tension, torque, bending moments, shear strains, pipe-well contact forces, extension, kinking, deformations of any element of the drill string and/or at any position of a given element. This mathematical model, frequently referred to in the art as a "torque and drag" model, may be that described in the publication SPE 98965 "Advancement in 3D drillstring mechanics: from the bit to the top drive" (Menand et al, 2006). This model also allows the actual modes of the drill string to be computed, i.e. the natural frequencies at which the drill string can start to vibrate.

Figure 15:
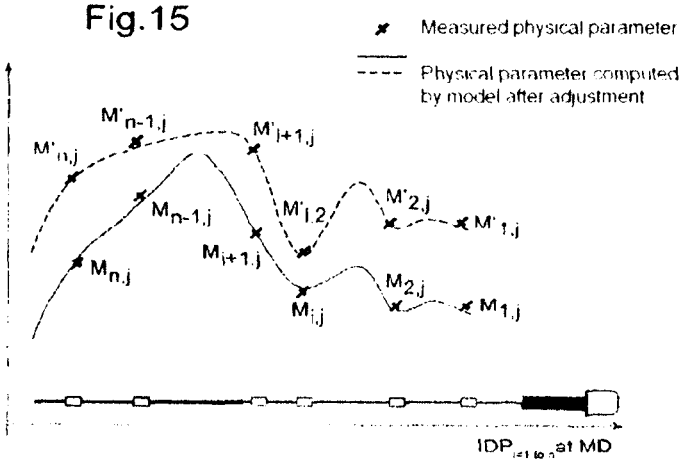
FIG. 15 shows two curves for parameters estimated from discrete measurements as a function of the rank of the pipes.
Figure 17:
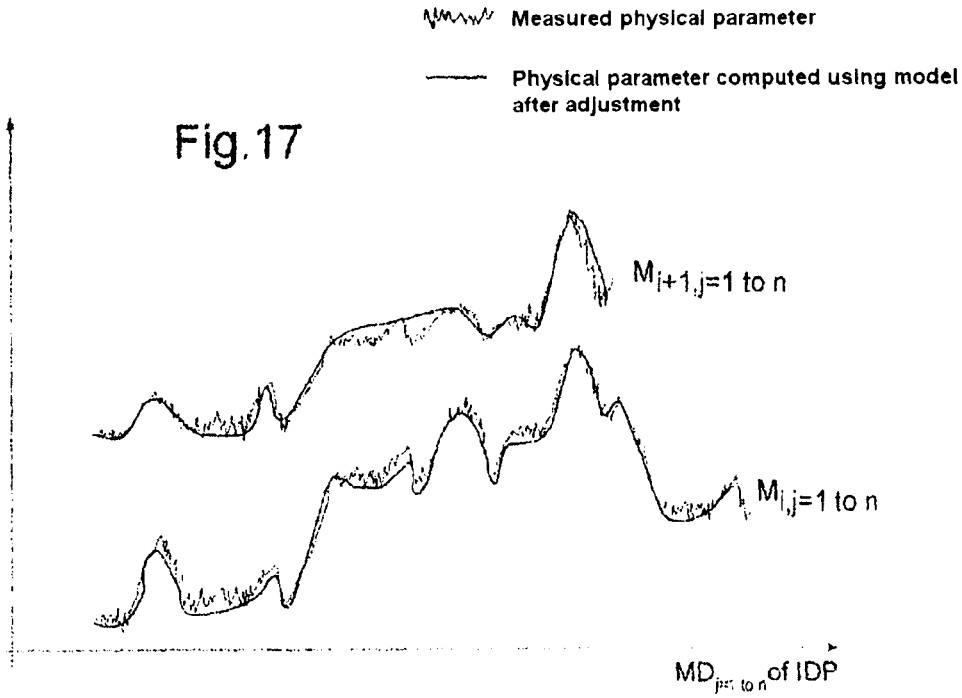
FIG. 17 shows two curves for parameters estimated from discrete measurements as a function of depth.

The method for determining the number and position of instrumented pipes is described in FIG. 13. The methodology described means that the number and position of the instrumented pipes in the drill string can be determined for drilling of a given drilled well. This determination generally takes place in the phase termed "planning" of a drilled well where the equipment necessary for carrying out the drilling operation is determined. This determination, including optimization of the number and position of the instrumented pipes, is important in that one defines a sufficient number of instrumented pipes positioned at selected places to be able to work out the mechanical behaviour of the whole of the drill string. Given known parameters of the mathematical model, a number n of instrumented pipes is positioned at an arbitrarily assigned spacing at the start of an iterative procedure (regular or irregular depending on the characteristics of the trajectory). A set of m simulations is then carried out with the mathematical model at different drilling depths (MD1 to MDn). The results of these m simulations are then analyzed in order to find out whether the positioning of the instrumented pipes is optimized in order to suitably describe the mechanical behaviour of the whole of the drill string and to correctly interpolate the measurements between two consecutive instrumented pipes. Knowing the mechanical behaviour of the whole of the drill string using measurements at discrete positions along the drill string is also desired. The quality of interpolation of the measurements via the mathematical model is thus of importance. If the number and the position of the instrumented pipes are adjudged optimal, then the number and the position of each instrumented pipe are defined. Since the instrumented pipe of rank 1 is at a distance DB1 from the drilling tool, the instrumented pipe of rank i is located at a distance DBi from the drilling tool, etc. If the position is not adjudged optimal, then the number and position of the instrumented pipes along the drill string are modified and the procedure is recommenced until an optimized position for the instrumented pipes along the drill string is obtained. This optimized position is aimed at ensuring that the mathematical model can satisfactorily interpolate the measurements from the instrumented pipes made at discrete locations along the drill string. The interpolation may be linear, quadratic or cubic in type. Since the instrumented pipe has similar dimensions to the other, standard, pipes, the mechanical behaviour of the string of pipes is conserved. Further, this also facilitates the interpolation of the measurements from the instrumented pipes to the other, standard, pipes due to their geometrical similarity. Examples of the production and use of the instrumented pipes are given in order to facilitate comprehension of this method (FIGS. 15 and 17). The number m of simulations may be different from the number n of instrumented pipes.

FIG. 14 shows a use of the measurements from the instrumented pipes during drilling with a view to processing by a mathematical model in order to detect dysfunctions (vibrations, buckling, etc) during drilling (real time processing). Given known parameters of the mathematical model, along with the number and positioning of the instrumented pipes, the mathematical model is used to carry out a simulation at a depth MDj. The measurements carried out on the instrumented pipes which may be pulled to the surface by the transmission means are analyzed and filtered for direct use by the mathematical model. These measurements are then compared directly with the results from the mathematical model. If the values computed by the mathematical model agree with the measurements from the instrumented pipes, then the mathematical model has estimated the mechanical behaviour of the whole drill string, including the mechanical behaviour of the non instrumented, standard, pipes positioned between the instrumented pipes. The tension, the contact forces between the pipes and the well walls, the bending moments, the deformations, the elongation, and the kinking are then known for the whole drill string, in particular by validating the measurements at discrete points, i.e. in the instrumented pipes. The absence of instrumented pipes would not allow this type of result to be obtained. In fact, measurements carried out only on the bottom hole assembly and at the surface would not provide information on what is happening in the string. Buckling, vibrations in the whole of the drill string or any other dysfunction of drilling in the drill string can be detected. If the values computed by the model do not agree with the instrumented pipe measurements, then the parameters of the mathematical model are adjusted and the simulation is carried out again at the same depth MDj. This iterative procedure is reiterated until the theoretical values agree with the measured values. A man-machine interface using the mathematical model and the iterative procedure described above could then be used to produce information which was useful to the well borer for monitoring the mechanical behaviour in the drill string assembly with a view to a better analysis of any dysfunctions.

One embodiment is shown in FIG. 15. The bottom hole assembly and the drill string provided with instrumented pipes are disposed at a depth MDj. Two different physical parameters or the same physical parameter measured at 2 different positions are measured by the instrumented pipes at discrete points and the same physical parameters computed by the mathematical model after interpolation using the mode described in FIG. 14. This physical parameter may be tension, torsion, bending moments, lateral acceleration, etc. The physical value may be estimated between two measurement points, and thus between two instrumented pipes. By an adjustment at discrete measurement points, it is possible to estimate the mechanical behaviour of the drill string assembly, and to gain a good idea of what is happening in the drill string.

FIG. 16 shows a use of the set of measurements from the instrumented pipes after the drilling operation with a view to optimizing drilling (post-analysis), for example optimization of the construction of the drill string. Given known parameters of the mathematical model, and the number and the position of the instrumented pipes defined, the mathematical model is used to carry out m simulations at several depths, MDj, from 1 to n. The set of measurements transmitted or stored on the instrumented pipes is recovered, analyzed and filtered for direct use by the mathematical model. These measurements are then directly compared with the results from the mathematical model. If the values computed by the mathematical model agree with the measurements from the instrumented pipes, then the mathematical model allows the mechanical behaviour of the drill string as a whole, including the mechanical behaviour of the non instrumented, standard, pipes, to be estimated, and at various drilling depths. The tension, the contact forces between the pipes and the well walls, the bending moments, the deformations, the elongation, the kinking are then known over the whole of the drill string. This also means that buckling, vibrations in the drill string as a whole or any other drilling dysfunction in the drill string can be detected. If the values computed by the model do not agree with the measurements from the instrumented pipes, then the parameters of the mathematical model are adjusted to carry out the m simulations at different depths MDj once again. This iterative procedure is reiterated until the theoretical values agree with the measured values.

One implementation is shown in FIG. 17. The Figure shows the change in a physical parameter measured using 2 instrumented pipes computed by the model after interpolation using the methodology described in FIG. 16, at various depths MDj. It will readily be understood from this figure that the methodology thus allows the change in stresses to which the drillpipes are subjected to be traced; this is particularly useful for fatigue and wear problems. Further, by quantifying the difference between the values computed by the mathematical model and the instrumented pipe measurements, this means that the zones of the drill string that are dysfunctional (vibrations, buckling) can be detected and the time which the pipes will be dysfunctional will be known. In fact, using the static mathematical model means that normal mechanical behaviour (no dysfunction) of the whole drill string can be determined. Any difference from this "normal" mechanical behaviour (no dysfunction) can then be interpreted as being abnormal and thus a potential dysfunction. The mathematical model can thus then allow the characteristics of the drill string to be tested in order to prevent dysfunctions, rendering possible an optimization of the construction of the drill stem.

Figures 18, 19, 20, 21, 22:
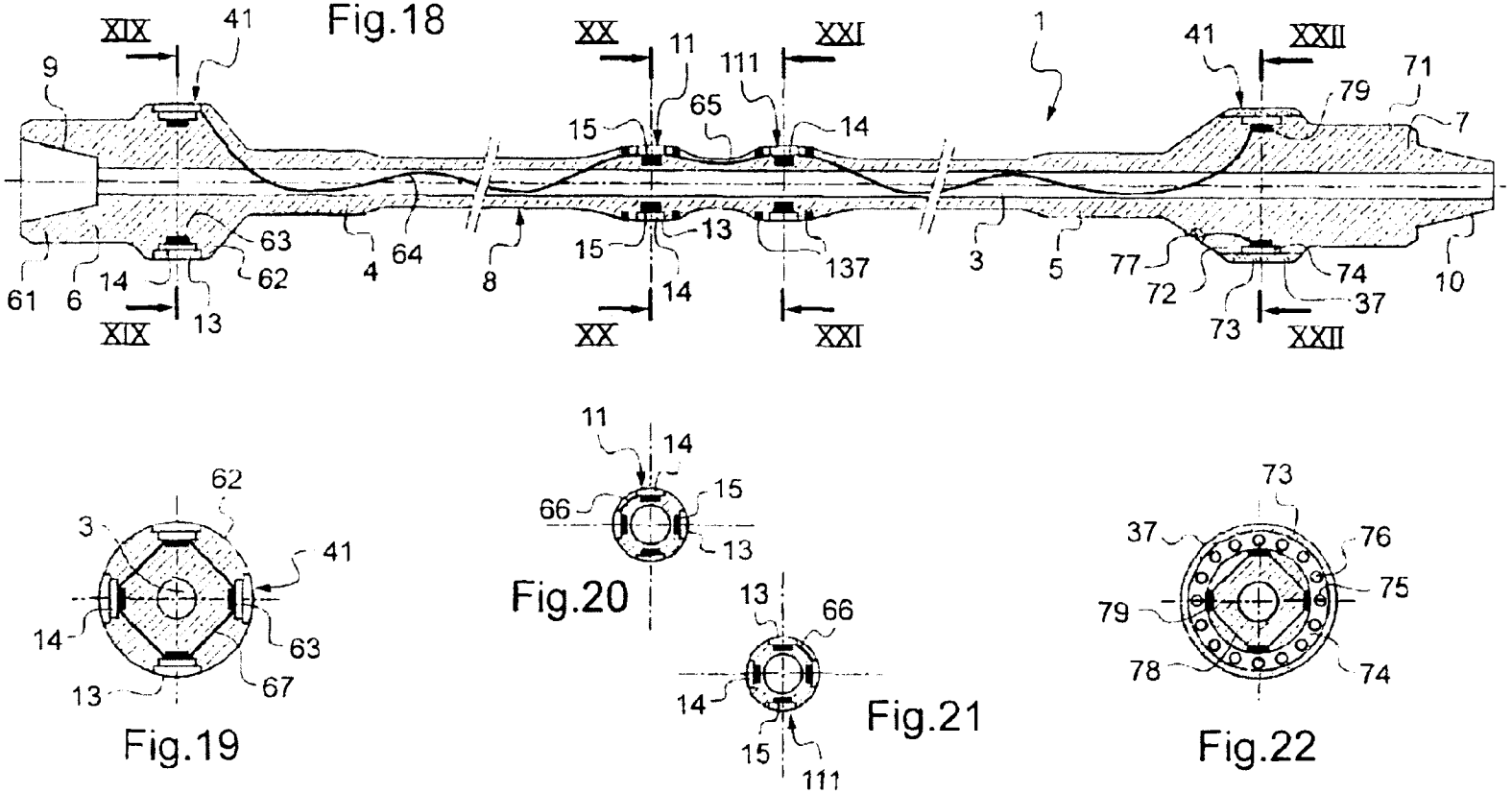
FIG. 18 is a sectional view in a radial plane of another embodiment of the drillpipe of FIG. 1.
FIGS. 19 to 22 are cross-sectional views of the drillpipe of FIG. 18 in an end section, in an intermediate zone and in an end section.

In the embodiment illustrated in FIG. 18, a pipe comprises at least one instrumented end section 6, 7. The section 6 comprises a nominal external diameter region 61 close to a terminal surface of the pipe and a region 62 with an external diameter greater than the nominal external diameter close to the intermediate zone 4. The inertia of the large external diameter region 62 is greater than the inertia of the nominal external diameter region 61. The large external diameter region 62 is located axially between the female connection portion 9 and the intermediate zone 4. The external surfaces of regions 61 and 62 are linked via a generally tapered intermediate surface. The external surfaces of the large external diameter region 62 and the intermediate zone 4 are linked via a generally tapered intermediate surface. The large diameter region 62 forms a supplemental casing 41.

Housings 14 are provided in the large external diameter region 62; see also FIG. 19. The housings 14, four in this case, are evenly distributed circumferentially. The housings 14 are pierced in the form of a blind hole. The axis of the housings 14 is radial. The housings 14 are radially aligned. Electronic processing modules 63 are disposed in the housings 14. The electronic processing modules 63 may be connected together. The electronic processing modules 63 are connected to the casing 11. The electronic processing modules 63 may be flexible in order to be able to constantly conform to the shape of a non-planar housing surface or to match a rounded surface. The electronic processing modules 63 comprise a repeater.

The section 7 comprises a region 71 with a nominal external diameter close to a terminal surface of the pipe and a region 72 with an external diameter that is greater than the nominal external diameter close to the intermediate zone 5. The inertia of the large external diameter region 72 is greater than the inertia of the nominal external diameter region 71. The large external diameter region 72 is located axially between the male connection portion 10 and the intermediate zone 5. The external surfaces of the regions 71 and 72 are linked via a generally tapered intermediate surface. The external surfaces of the large external diameter region 72 and the intermediate zone 5 are linked via a generally tapered intermediate surface. The large diameter region 72 is provided with a hard coating 37. The large diameter region 72 forms a supplemental casing 41. More particularly, the large diameter region 72 comprises a large diameter sheath 73 forming part of the external surface of said region 72. The sheath 73 comprises the hard coating 37. Alternatively, the sheath 73 is produced from a hard material, especially with a hardness that is greater than the hardness of the intermediate zone 5, for example with a hardness of more than 35 Rockwell HRC. The sheath 73 is fixed to the body of the large diameter region 72 with screws. The large diameter region 72 comprises an annular barrel 74 disposed between the body of the large diameter region 72, which is integral with the region 71, and the sheath 73. The barrel 74 is disposed in an annular groove provided in the body of the large diameter region 72 from an external surface. The barrel 74 may be produced from a flexible material, for example a synthetic material. The barrel 74 may be produced in two complementary semi-circular parts. The barrel 74 is retained by the sheath 73.

The barrel 74 comprises a plurality of housings 75; see also FIG. 22. The housings 75, sixteen in this case, are evenly circumferentially distributed. The housings 75 are pierced in the form of blind holes. The housings 75 are axially orientated. The housings 75 are radially aligned. Sources of electrical energy 76 are disposed in the housings 75. The sources 76 are connected to the casing 11. The sources 76 may comprise cells or batteries in the form of a cylinder of revolution. The housings 75 may be suitable for standard size commercially available sources. Positioning the housings 75 with their axes parallel means that a large number of sources can be accommodated. A large amount of energy can be stored therein, allowing long-term operation. The axes of the housings 75 are parallel to the axis of the pipe. The large diameter region 72 is provided with a connector 77 for connection with a complementary connector, not shown, outside the pipe. The complementary connector may be connected to a battery charger, to a memory to pick up data, to a processing device, etc. Electronic or electrical modules 79 are disposed in recesses provided in the body of the large diameter region 72. The modules 79 are surrounded by the bore of the barrel 74. The modules 79 may comprise sensors, emitters, etc. The modules 79 may comprise processing electronics. The modules 79 are connected to the sources 76. The modules 79 are connected to the connector 77.

Figure 26:
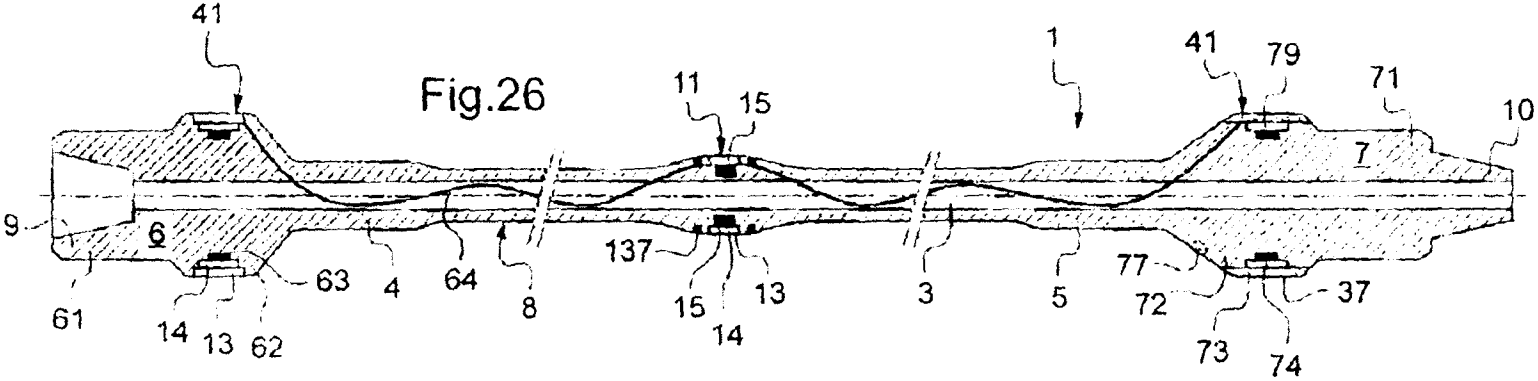
FIG. 26 is a variation of FIG. 18.

In the embodiment illustrated in FIG. 18, the pipe comprises two casings 11, 111. In the embodiment illustrated in FIG. 26, the pipe comprises one casing 11. The casing 11, 111 is integral with the central section 8. The casing 11, 111 has a domed external surface with a large radius of curvature in axial section. As an example, the radius of curvature may be greater than the nominal diameter of the pipe. The casing 11, 111 comprises four chambers 14. The chambers 14 are axially aligned. The chambers 14 are circumferentially distributed. The casing 11, 111 has a circular external surface. The diameter of the circular external surface of the casing 11, 111 is greater than the diameter of the central section 8, for example by approximately 15% to 30%. At least one sensor 15, in particular for deformation or a strain gauge, is disposed in a chamber 14. Inserts 137 formed from hard materials, for example tungsten carbide, are provided on and flush with the surface of the casing 11, 111, see FIG. 23. The inserts 137 may be in the form of pellets, especially round pellets. The pellets have a diameter of 5 to 15 millimeters. The inserts 137 may be disposed around covers 13 for the chambers 14. The inserts 137 may be disposed in two rings around the chambers 14. Alternatively, the inserts 137 may be disposed in two rings around the casing 11, 111.

The connection between the electronic processing modules 63 and the casing 11 and/or between the electronic processing modules 63 and the casing 11 may be provided by a communications tube 64 disposed at least in the bore of the central section 8 and in contact with said bore. A signal and/or energy transmission cable may be disposed in the tube. The communications tube 64 may comprise a body formed by at least one metallic strip disposed with an annular component. In section in a plane passing through the axis of the tube, the body comprises at least two axially elongate sections that partially overlap each other with an axial clearance selected to absorb the maximum elastic deformation of the component under axial compressive and/or bending load. Reference may be made in this respect to FR 2 940 816.

The communications tube 64 may be inserted into the large external diameter regions 62 and 72 and into the casing 11 into a hole in accordance with FR 2 936 554; the reader is invited to refer thereto.

Figure 23:
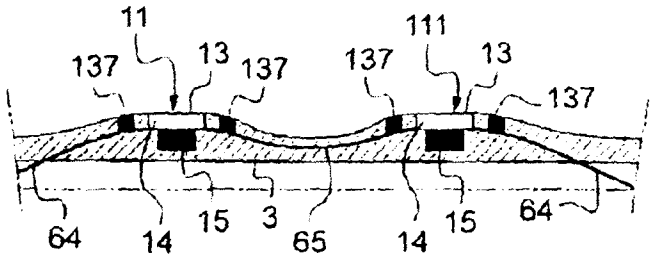
FIG. 23 is a detailed view of FIG. 18.
Figure 24:
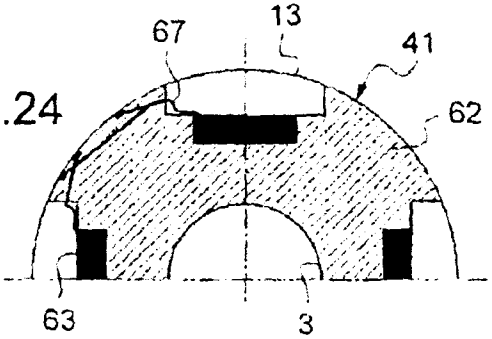
FIG. 24 is a detailed view of FIG. 20.

In the embodiment illustrated in FIGS. 18 and 23, a transmission cable 65 connects the chamber 14 of the casing 11 to the chamber 14 of the casing 111. In FIGS. 20 and 21, a transmission cable 66 connects two chambers 14 of the same casing 11, 111. To this end, an aperture is provided in the thickness of the casing 11, 111, for example two straight apertures each starting from a chamber 14 and joining up mid-way. All of the chambers 14 of a casing 11, 111 may be connected in this manner. In the embodiment illustrated in FIG. 24, the transmission cable 66 passes through three straight apertures that intersect, for example one starting from one chamber 14 to the external surface of the supplemental casing 41, the second, which is blind, starting from the opening of the first, the third extending from another chamber 14 to the external surface of the supplemental casing 41, meeting the second in the thickness of the wall. In FIG. 19, a transmission cable 67 connects the chambers 14 of the supplemental casing 41. In FIG. 22, a transmission cable 78 connects the modules 79 of the supplemental casing 41.

Figure 25:
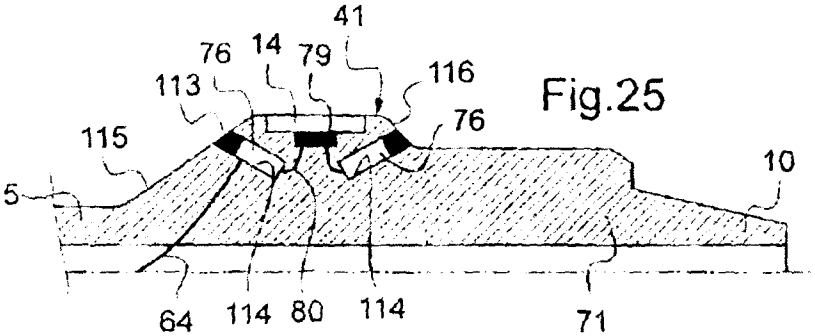
FIG. 25 is a detail of a variation of FIG. 18.

In the variation of FIG. 25, the large external diameter region 72 comprises housings 14 analogous to the housings 14 of the region 62. The large external diameter region 72 comprises housings 114 in the form of blind holes with a circular section. The housings 114 are provided from the generally tapered intermediate surfaces 115, 116 respectively between the intermediate zone 5 and the large external diameter region 72, and between the large external diameter region 72 and the nominal external diameter region 71. The housings 114 are disposed in axes disposed in a plane passing through the axis of the pipe and intersecting the axis of the pipe. The axes of the housings 114 may be inclined by 10° to 40° with respect to the axis of the pipe. The housings 114 are obscured by covers 113. Sources 76 are disposed in the housings 114. The inclination of the housings 114 means that advantage can be taken of the thickness of the large external diameter region 72 in constituting an energy reservoir. The housings 114 are connected to the communications tube 64. The housings 114 are connected to the modules 79 via cables 80.

The drillpipe may comprise an energy storage region, a data processing region and a mechanical parameter detection region. The energy storage region may comprise a plurality of housings for energy sources. The energy storage region may be located at one end. The data processing region may comprise a plurality of housings for electronic processing modules. The data processing region may be located at one end. The mechanical parameter detection region may comprise a plurality of mechanical parameter sensors. The mechanical parameter detection region is located in a casing disposed in a central zone at a distance from the ends and from the intermediate zones. The maximum external diameter of the casing may be less than the maximum external diameter of one or the other of the ends.

Figure 27:
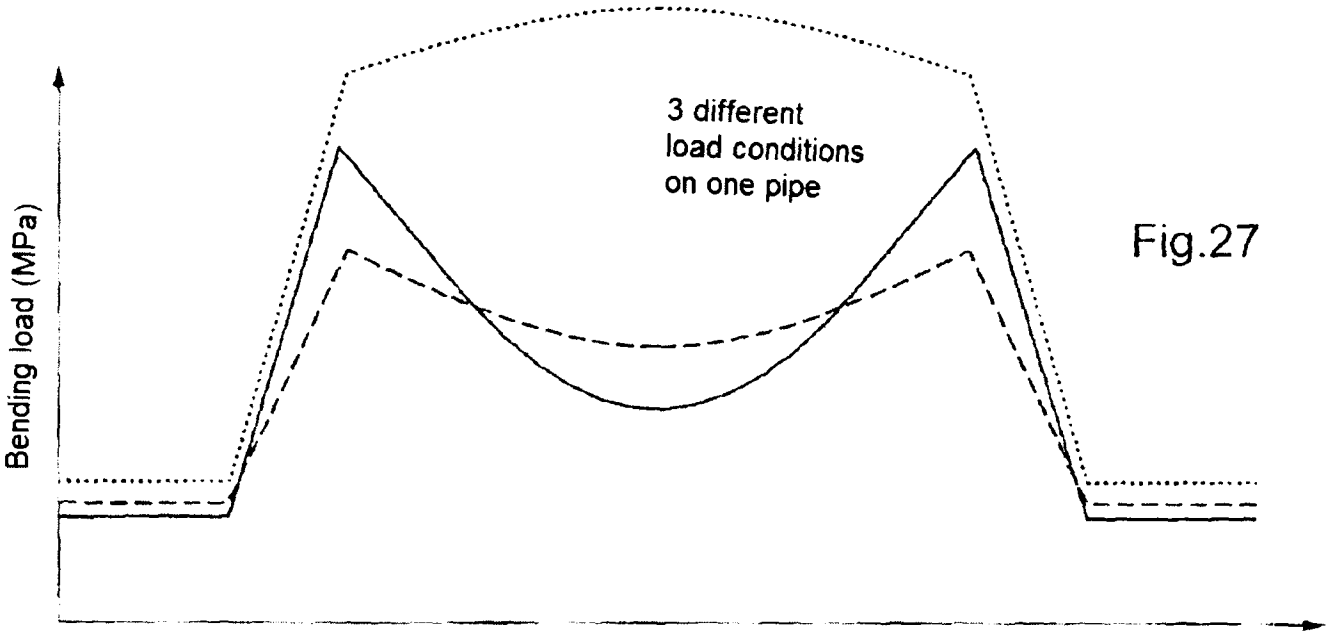
FIG. 27 is a graph of bending stress as a function of position on the axis of the pipe for various load conditions.
Figure 28:
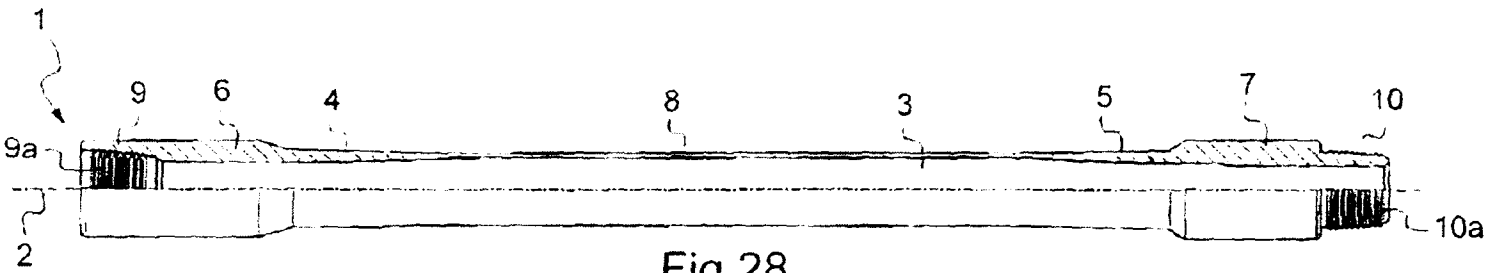
FIG. 28 is an axial sectional view of a drillpipe The drawings contain distinct, fixed elements. Thus, they not only serve to provide a better understanding of the present invention but also contribute to its definition if appropriate.

FIGS. 27 and 28 show the change in bending stress expressed in MPa along the pipe. As before the pipe comprises a central section 8, end sections 6, 7 and intermediate zones 4, 5. The pipe of FIG. 28 is aligned with the curve of FIG. 27 in order to match the curve with the profile along the pipe. FIG. 28 includes three curves established for three axial stress conditions (tension/compression). These curves include characteristic zones which are distinct from each other and correspond to the central section 8, to the end sections 6, 7 and to the intermediate zones 4, 5. The curve shown in dotted lines was established by compression without lateral contact of the pipe with a wall of the well. The solid line curve was established under tension with no lateral contact of the pipe with a wall of the well. The dashed line curve was established under a tension that was higher than the preceding case, with no lateral contact of the pipe with a wall of the well. In the case of lateral contact, the continuous and dashed curves would be W-shaped with a small local maximum at the centre, instead of a V-shaped appearance. Thus, it is very important to dispose the mechanical parameter sensors in the central section 8. Sensors are also envisaged in the intermediate zones 4, 5—see the embodiments with supplemental casing(s) 41 around an intermediate zone.

The invention claimed is:

1. A drillpipe for a drill stem to drill a hole, the drill stem including a drill string and a bottom hole assembly, the drillpipe comprising:

a first end comprising a female threading and having a first inertia;

a second end comprising a male threading and having a second inertia;

a first intermediate zone adjacent to the first end and having a third inertia;

a second intermediate zone adjacent to the second end and having a fourth inertia;

a central substantially tubular zone with an external diameter which is smaller than the maximum external diameter of at least the first or the second end and having a fifth inertia, the third and fourth inertias each being smaller than the first and second inertias and the fifth inertia being smaller than the third and fourth inertias;

a casing fixed on the pipe over a portion of the external surface of the pipe;

at least one physical parameter sensor disposed in the casing; and at least one data transmission or storage device connected to the sensor output;

the casing being disposed at a distance from the first and second ends, and the casing being integral with the central zone at a distance from the first and second intermediate zones and having a smaller inertia than the first and second inertias.

2. The pipe according to claim 1, wherein the casing has an external surface which is inscribed in a circle, the maximum external diameter of which is less than or equal to the maximum external diameter of both the first end and the second end.

3. The pipe according to claim 1, wherein the thickness of the material of the casing between the sensor and a bore of the pipe is greater than or equal to the thickness of the central zone of the pipe.

4. The pipe according to claim 1, wherein the casing comprises a base integral with the central zone and a removable sealing cover.

5. The pipe according to claim 4, wherein the base has an external surface tangential to the external surface of the central zone, the base forming a boss with respect to the central zone.

6. The pipe according to claim 1, comprising at least one sensor selected from: a temperature sensor, a strain gauge, a deformation sensor, a pressure sensor, and an accelerometer.

7. The pipe according to claim 1, wherein the data transmission or storage device comprises a memory.

8. The pipe according to claim 1, wherein the casing is disposed 3 meters or more from the plane located midway between the intermediate zones.

9. The pipe according to claim 1, wherein the casing is a single piece.

10. The pipe according to claim 1, further comprising a supplemental casing integral with one end or an intermediate zone.

11. The pipe according to claim 1, further comprising an anti-abrasion coating disposed on at least a portion of the external surface of at least one end of the pipe or of a supplemental casing produced on one end of the pipe, the portion having a diameter that is the largest diameter of the pipe.

12. The pipe according to claim 1, wherein the casing comprises a plurality of covers with a threaded edge.

13. The pipe according to claim 1, wherein at least one casing has a length of less than 150 mm, or is 130 mm.

14. The pipe according to claim 1, wherein the casing comprises bosses.

15. The pipe according to claim 14, wherein the bosses are disposed in circular arrays, at least one of the arrays comprising an anti-abrasion coating and having an external diameter that is greater than the external diameter of at least one adjacent array.

16. The pipe according to claim 1, further comprising at least one source of electrical energy disposed in the casing and supplying the sensor.

17. The pipe according to claim 1, wherein the portion of the external surface of the pipe is tubular.

18. The pipe according to claim 1, further comprising a barrel disposed in one end and comprising housings for sources of electricity.

19. The pipe according to claim 1, further comprising housings for sources of electricity, the housings having axes intersecting a longitudinal axis of the pipe.

20. The pipe according to claim 1, wherein the casing is at a distance from the first and second intermediate zones in a range 40% to 60% of a distance between the first intermediate zone and the second intermediate zone.

21. A drill stem comprising the drillpipe according to claim 1, said drill stem comprising:

a drill string; and a bottom hole assembly, the bottom hole assembly comprising a drill bit, the drill string being disposed between the bottom hole assembly and a means for driving the drill string, the drill string comprising the drillpipe mounted at locations selected in accordance with indications from a mathematical model of mechanical behavior of the drill stem.

* * * * *